United States Patent [19]

Noé et al.

[11] Patent Number: 4,819,470

[45] Date of Patent: Apr. 11, 1989

[54] METHOD FOR CONTINUOUSLY STRAIGHTENING THIN METAL STRIPS

[75] Inventors: Oskar Noé; Rolf Noé; Andreas Noé, all of Mülheim; Hermann Koppers, Duisburg, all of Fed. Rep. of Germany

[73] Assignee: BWG Bergwerk-und Walzwerk-Maschinenbau GmbH, Fed. Rep. of Germany

[21] Appl. No.: 140,955

[22] Filed: Dec. 28, 1987

Related U.S. Application Data

[63] Continuation of Ser. No. 776,435, Sep. 16, 1985, abandoned.

[30] Foreign Application Priority Data

Apr. 20, 1986 [DE] Fed. Rep. of Germany ..... 3514357

[51] Int. Cl.[4] ..... B21D 1/02; B21D 25/00

[52] U.S. Cl. ..... 72/161; 72/183; 72/205

[58] Field of Search ..... 72/160, 161, 163–165, 72/183, 205

[56] References Cited

U.S. PATENT DOCUMENTS

| | | | |
|---|---|---|---|
| 3,348,400 | 10/1967 | Korf | 72/161 |
| 3,374,653 | 3/1968 | Zeigler | 72/183 |
| 3,427,848 | 2/1969 | Gay | 72/161 |
| 3,626,737 | 12/1971 | Defontenay | 72/205 |
| 3,641,797 | 2/1972 | Bell et al. | 72/205 |
| 3,686,921 | 8/1972 | Roper | 72/161 |
| 3,839,888 | 10/1974 | Greenberger | 72/205 |
| 3,924,428 | 12/1975 | Noe | 72/183 |

FOREIGN PATENT DOCUMENTS

| | | | |
|---|---|---|---|
| 455770 | 1/1974 | U.S.S.R. | 72/161 |
| 712173 | 1/1980 | U.S.S.R. | 72/378 |
| 631081 | 10/1949 | United Kingdom | 72/161 |

*Primary Examiner*—Daniel C. Crane

*Attorney, Agent, or Firm*—McGlew & Tuttle

[57] ABSTRACT

A method of continuously straightening metal strip comprises directing the strip over devices which act on the strip to effect its straightening by first causing a stretching and leveling and thereafter stretching and bending. The device for continuously straightening the thin metal strip comprises a plurality of entrance rollers arranged in succession at an entrance portion and a plurality of delivery rollers arranged in succession at a delivery portion with a stretching and bending device arranged between the two portions. The metal strip is guided over the entrance and delivery rollers as the rollers are driven by a drive motor and a common device member driven by the motor. At least two of the entrance rollers and at least two of the delivery rollers are tensioning rollers. A differential is included in the drive of each tensioning roller and it includes an overdriving motor with an adjustable speed.

5 Claims, 2 Drawing Sheets

METHOD FOR CONTINUOUSLY STRAIGHTENING THIN METAL STRIPS

This application is a continuation of application Ser. No. 776,435, filed Sept. 16, 1985, abandoned.

FIELD AND BACKGROUND OF THE INVENTION

The invention relates to a method and a tensioning device for the continuous straightening of metal strip, in particular thin strip. Within the scope of the invention, thin metal strip is understood to be strip with a thickness of up to 1 mm. For very soft materials, such as zinc, aluminum, etc., the thickness of the strip may be as much as 3 mm, however.

Essentially two methods are known for the continuous straightening of metal strip, i.e; stretcher leveling, in which the metal strip is elongated by being pulled between two sets of tensioning rolls, and the stretching-and-bending method using two or more bending rolls between two sets of tensioning rolls.

If the stretcher leveling method is used on wavy metal strips, fibers or particles of different length are plastically elongated to a different extent and therefore strengthened to varying degrees. In this metal strips zones differing in strength cause undesirable residual waviness. In addition, there is the danger that the strip will break and this danger increases with the stretching ratio. For metal strip with strip sabre or strip dimples, stretcher leveling cannot be used because the strip breaks frequently.

In the stretching-and-bending method metal strip is straightened by combined tensile and bending stresses in the area of bending rolls with a small diameter. The tension applied to the strip in this case is considerably lower than in the stretcher leveling method. It is possible to operate with a high stretching ratio without breaking the strip; this simultaneously eliminates the strip sabre. If the stretching-and-bending method is used on thin metal strips which are stretched more than 1%, flaws in the strip middle may occur, whose size increases with the stretching ratio and the strip width. In addition, residual stresses remain in the metal strip which are generated by the bending stresses and which may cause, for example, a transverse curvature, the so-called cross bow. Both straightening methods themselves are not well suited for straightening thin metal strip with low intrinsic stiffness, particularly not for metal strip with a low modulus of elasticity, e.g. aluminum strip with thicknesses between 0.1 and 0.35 mm.

SUMMARY OF THE INVENTION

The invention provides a method and a tensioning device for the continuous straightening of particularly thin metal strips by the use of which residual waviness, cross bow or middle flaws are eliminated and which, in addition, prevent the generation of unevenly distributed residual stresses in the cross section of the strip or in the plane of the strip and also the danger of breaks in the strip.

In accordance with the invention the metal strip is straightened with the aid of a combination of a stretcher leveling method and a stretching-and-bending method. According to the invention the metal strip is straightened by first applying the stretching-and-bending method and then the stretching-leveling method. Preferably stretcher leveling is carried out in the area of the strip with opposite curvature. The invention is based on the finding that in stretcher leveling residual stresses are generated by fibers or strip zones which have been plastically elongated to various degrees. If no tension is applied, the fibers and zones which were stretched to a higher degree have more spring action than those fibers and zones which were stretched only a little. As thin metal strips, in particular, have only very small intrinsic stiffness, residual waviness will be generated by these different degrees of springback, in particular in metals with a low modulus of elasticity.

Another factor on which the invention is based is the finding that in stretching-and-bending operations the occurrence of so-called middle flaws is due to the fact that the longitudinal bending stresses generate transverse stresses which are perpendicular to the longitudinal bending stresses. In the direction of the strip width these transverse stresses are zero at the edge of the strip and increase to a maximum at the center of the strip. The stretching ratio on the center zone of the strip is therefore slightly higher than that in the edge zones. According to the invention a wavy metal strip is consequently first subjected to a stretching-and-bending operation with such a stretching ratio that all waviness and or strip sabre are eliminated. Then the metal strip undergoes a stretcher leveling operation with a low stretching ratio, for example, 0.2 to 0.3%. Thanks to this method it is possible to use any stretching ratio that may be required for removing waviness or residual waviness and yet not run any danger of breaking the strip. The middle flaws caused thereby are then removed by the subsequent stretcher leveling operation in the plastic range. Simultaneously the residual stresses generated by the stretching-and-bending operation are eliminated by the plastic deformation of the entire cross section effected by stretcher leveling. The metal strip which has been treated in accordance with the teachings of the invention contains substantially no residual stresses.

Another subject of the invention is a tensioning device for practicing the claimed method. This device comprises at least two tensioning rolls at the entrance and at least two tensioning rolls at the deliver end, with a differential being assigned to each tensioning roll. The differentials are designed as overriding drives. The overriding inputs of the overriding drives are driven by adjustable-speed overriding motors. A stretching-and-bending device is combined with the tensioning device. This tensioning device is characterized in that the tensioning rolls at the delivery end form the stretcher leveling section. The stretcher leveling operation takes place, like the stretching-and-bending operation, between two tensioning rolls. It is the teaching of the invention that in a tensioning device with two or four tensioning rolls each at the entrance and delivery end, respectively, the tensioning roll which is the first one in the running direction of the strip is operated as a braking roll and the second tensioning roll, or the other tensioning rolls, is, or are, operated as pulling rolls. As a result of this arrangement the stretcher leveling section is formed between the braking roll and the pulling rolls. The stretching-and-bending device is usually between the tensioning rolls at the entrance and delivery ends, so that the stretching-and-bending operation takes place between the last tensioning roll at the entrance side and the first tensioning roll at the discharge end. In principle the stretching-and-bending device can also be located in another part of the strip, for example between the second and third tensioning roll at the entrance or discharge end if the tensioning device comprises four tensioning rolls each at the entrance and discharge ends. For a tensioning device with four tensioning rolls each at the entrance and discharge ends there also exists the possibility that at the discharge end the first two tensioning rolls in the running direction of the strip are used as braking rolls and the last two tensioning rolls as pulling rolls and that the stretcher leveling section is formed in this manner.

In the tensioning device used, the overriding drives are preferably connected in parallel to a common drive shaft or pinion chain and according to the teaching of the invention an overriding drive with fixed overriding input or a drive with a fixed gear ratio is connected, with the overriding motor being eliminated, to the last tensioning roll (in the running direction of the strip) in the entrance section and/or the first tensioning roll in the discharge end, which overriding drive (or drive with a fixed gear ratio) is driven by a drive motor through the common drive shaft or common pinion chain. In such a tensioning device the tensioning roll in question, simply by reversing an overriding motor, can be made to operate as a braking roll instead of a pulling roll. Apart from this, the tensioning roll connected to the fixed ratio input or to the drive with a fixed gear ratio acts as a so-called speed control for the entire tensioning device. This speed control can be either at the entrance or at the discharge end.

The invention teaches further that measuring devices, for example measuring wheels, are associated with the tensioning rolls forming the stretcher leveling section in order to determine the plastic elongation of the strip in the stretcher leveling section and that, when a deviation from the set value occurs, at least one of the overriding motors of the overriding drive in question is readjusted with the aid of a control device. An analogous method is used for the stretching-and-bending process. In this respect the invention teaches that measuring device, for example measuring wheels, for the purpose of determining the plastic elongation caused by stretching-and-bending are associated with the last tensioning roll in the entrance section and the first tensioning roll at the delivery end in the running direction of the strip and that, if the elongation deviates from the set value, at least one of the overriding motors of the overriding drive in question is readjusted, also with the aid of a control device. If during the stretcher leveling and the stretching-and-bending operations deviations from the set value occur, at least one overriding motor at one or the other tensioning roll, or at the associated overriding drive, is readjusted.

The advantages achieved by means of the invention are essentially that a method and a tensioning device are described which permit, in a simple manner and with a minimum of equipment, straightening of the processed metal strips by stretching-and-bending and/or stretcher leveling, as desired. According to the maximum considerations of the invention, thin metal strips are first bent-and-stretched and then stretcher leveled. But in principle it is also possible to straighten metal strips by stretcher leveling first and stretcher-and-bending afterwards. For certain materials this offers an advantage, for example for silicon steel strip in which residual stresses remaining after the straightening are intended to generate certain textures in a subsequent annealing process. If the wide range of metal strips with different thicknesses is taken into consideration, the tensioning device of the invention can be used both for straightening thick metal strip by using only the stretching-and-bending method. This makes it unnecessary to provide two separate tensioning devices or facilities, one for thin and one for thick metal strips. The control of the stretching ratio by overriding motors is particularly advantageous because due to their low moments of inertia they ensure extremely fast adjustment. It is advantageous to operate all overriding motors initially just below the tension level required for stretcher leveling. One overriding motor then takes over the control of the stretching ratio in the stretcher leveling range and another one does so in the bending-and-stretching range, while the other overriding motors can remain on the initial tension level.

In any case, according to the teaching of the invention it is possible to straighten thin metal strips, in particular, in such a manner that residual waviness, cross bow or middle flaws no longer occur. Any unevenly distributed residual stresses in the wall cross section or the wall plane will be eliminated, and the danger of breaking is eliminated.

Accordingly it is an object of the invention to provide an improved method of continuously straightening particular thin metal strip which comprises directing the strip over devices which act on the strip to effect straightening by first causing a stretching and leveling and thereafter a stretching and bending.

A further object of the invention is to provide a device for continuously straightening, poarticularly thin metal strip which comprises a plurality of entrance rollers and delivery rollers arranged in succession on each side of stretching and bending device. The metal strip being guided over the rollers and through the stretching device between the roller portions and in a driving arrangement wherein the tensioning rollers are driven by a differential providing an overriding drive.

A further object of the invention is to provide a straightening device for thin metal strip which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
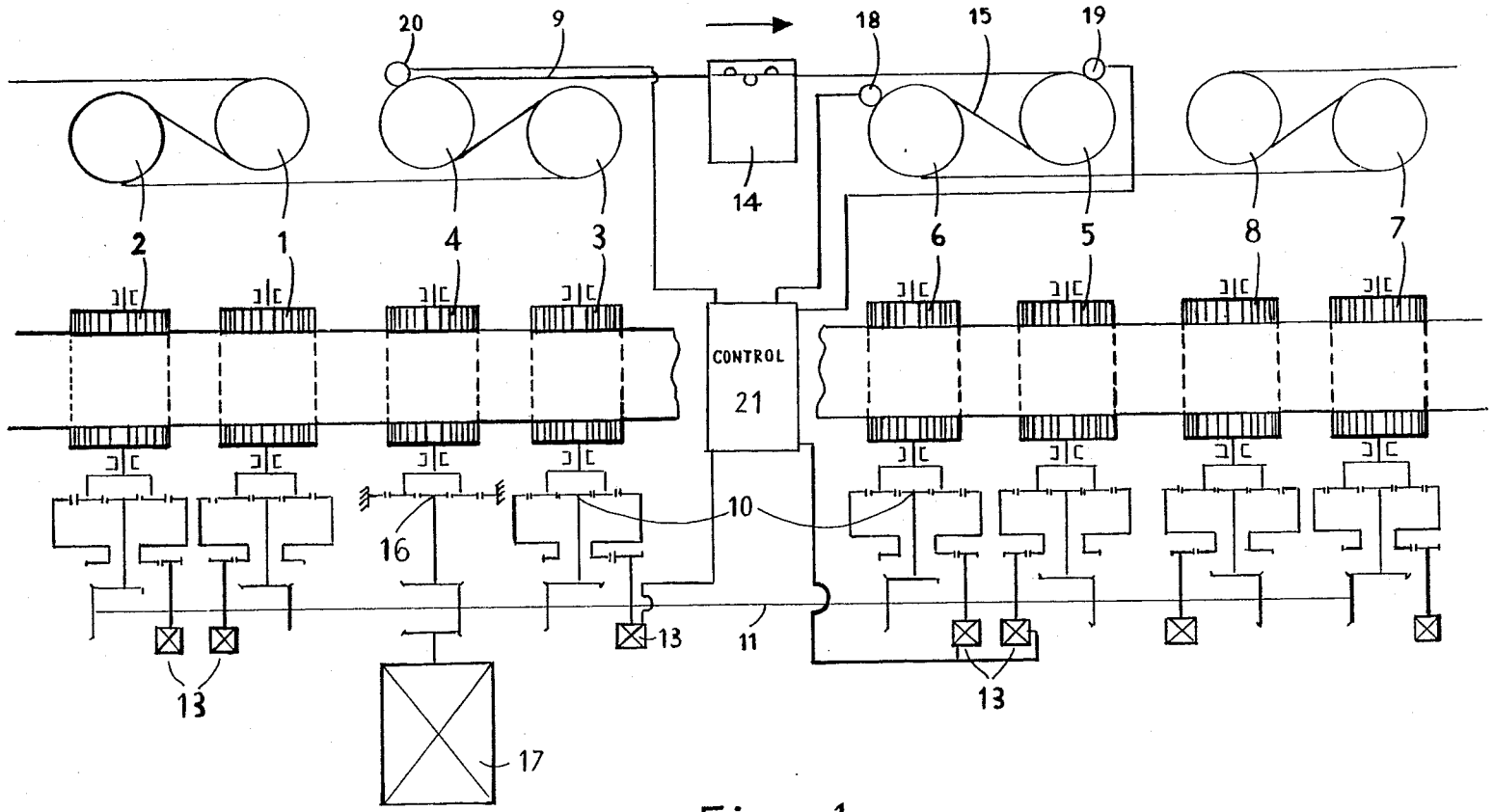
FIG. 1 is a schematic representation of a tensioning device according to the invention with a speed control in the entrance section and with a common drive shaft.

Referring to the drawings in particular, the invention embodied therein comprises a method for continuously straightening particularly a thin metal strip 9 by directing it over a series of rollers 1,2,3,4,5,6,7 and 8. The rollers are arranged in succession on each side of a stretching and bending device 14 and the metal strip is directed over the rollers which act on the strip to effect its straightening by first causing a stretching and leveling and thereafter a stretching and bending. Advantageously the metal strip 9 may first be stretched-and-bent and then stretcher leveled. The stretcher leveling of the strip advantageously takes place in a section of the strip with opposite radial curvature.

Figure 2:
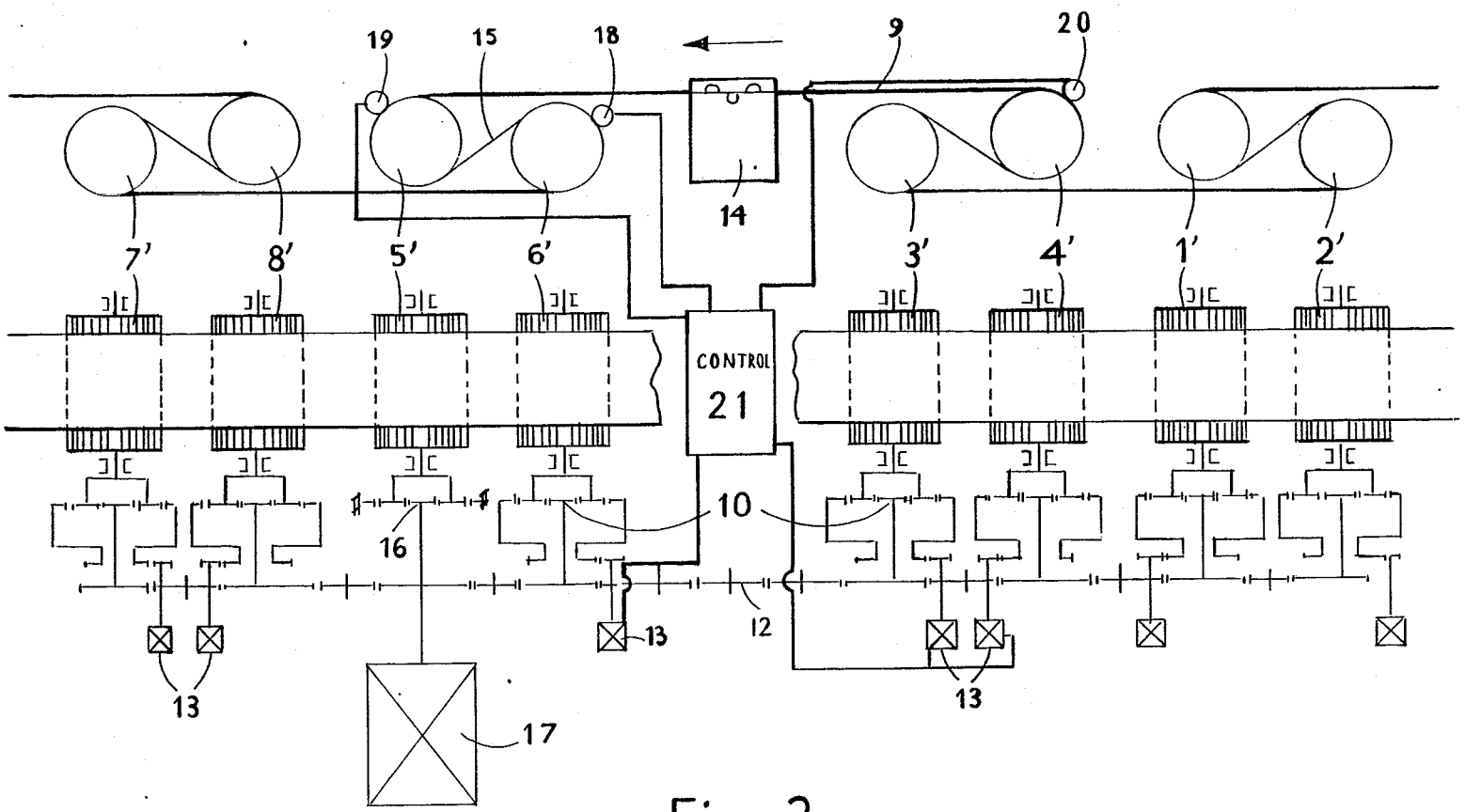
FIG. 2 is a view similar to FIG. 1 with a speed control in the delivery section and with a common pinion chain.

The drawings show a tensioning device for continuously fed strip, in particular thin metal strip, with at least two tensioning rolls 1 and 2 or 1' and 2' in the entrance section and two tensioning rolls 5 and 6 or 5' and 6' in the delivery section, in which the metal strip 9 in question is straightened by combined stretching-and-bending and stretcher leveling. A differential or overdrive arrangement 10 is provided for each tensioning roll with the exception of tensioning roll 4 in the entrance section and tensioning roll 5' in the delivery section. The differentials 10 are designed as overriding drives and, according to FIG. 1, are connected in parallel to a common drive shaft 11, and, according to FIG. 2, to a common pinion chain 12. The overriding inputs of the overriding drives are powered by adjustable, variable torque or variable speed, overriding motors 13. A stretching-and-bending device 14 is located between the tensioning rolls in the entrance and the delivery sections. In the embodiments shown the stretching-and-bending of metal strip 9 being processed consequently takes place between the last tensioning roll 4 or 4' in the entrance section and the first tensioning roll 5 or 5' in the delivery section. The two tensioning rolls 5,6, or 5',6' in the delivery end form a stretcher leveling section.

In the tensioning device shown, which comprises four tensioning rolls 1 to 4 in the entrance section and four tensioning rolls 5 to 8 in the delivery section, the design is such that in the delivery section the first tensioning roll 5 or 5' in the running direction of the strip is operated as a braking roll and the other tensioning rolls 6 to 8, or 6' to 8' are operated as pulling rolls, and it is this arrangement which forms the stretcher leveling section 15 between the braking roll 5 or 5' and the pulling rolls 6 to 8 or 6' to 8'.

Stretcher leveling therefore takes place with the strip being curved in the opposite direction. In the moving direction of the strip there is associated with the last tensioning roll 4 in the entrance section and/or the first tensioning roll 5' in the delivery section, and without an overriding motor being used, an overriding drive with fixed overriding input or, as shown in the drawing, a drive 16 with fixed gear ratio, which is driven by drive motor 17 through the common drive shaft 11 or pinion chain 12.

Measuring devices 18, 19, for example measuring wheels, for measuring the plastic elongation of the strip in stretcher leveling section 15 are associated with the tensioning rolls 5, 6 or 5', 6' which form stretcher leveling section 15. If a deviation from the set value occurs, at least one of the overriding motors 13 of the overriding drives 10 in question is readjusted with the aid of a control device 21 connected between the measuring devices 18 and 19 and the motors 13. In the running direction of the strip measuring devices 20, 19, for example measuring wheels, for the purpose of determining the plastic elongation caused by stretching-and-bending are associated with the last tensioning roll 4, 4' in the entrance section and the first tensioning roll 5,5' in the delivery section. In this case, too, at least one of the overriding motors 13 of the overriding drives 10 in question is readjusted with the aid of a control device if a deviation from the set value occurs.

While specific embodiments of the invention have been shown and described in detail to illustrate the application of the principles of the invention, it will be understood that the invention may be embodied otherwise without departing from such principles.

What is claimed is:

1. A method for the continuous straightening of metal strips with a tensioning device having a first tensioning roll and a second tensioning roll, the method comprising the steps of:

passing the metal strip over the first tensioning roll in a first rotational direction;

passing the metal strip over the second tensioning roll in a rotational direction opposite to that of said first rotational direction;

forming a stretcher levelling section between the first and second tensioning rolls such that the metal strip is curved in a first direction by the first tensioning roll and in a second direction by the second tensioning roll;

selectively operating the first tensioning roll at a first rotational speed; selectively operating the second tensioning roll at a second rotational speed different from said first rotational speed so as to selectively cause a longitudinal stretching in said stretcher levelling section plastically elongating the metal strip throughout its entire cross-section; and subjecting the metal strip to a stretching and bending in a stretching and bending device by feeding the metal strip through stretching and bending rolls at a location longitudinally separate from the first and second tensioning rolls, said metal strip being continuously passed through said stretcher levelling section and said stretching and bending device.

2. A method according to claim 1, wherein: said step of subjecting the metal strip to a stretching and bending in a stretching and bending device is carried out subsequent to said forming a stretcher levelling section between the first and second tensioning rolls.

3. A method according to claim 1, wherein: said step of subjecting the metal strip to a stretching and bending in a stretching and bending device is carried out prior to said step forming a stretcher levelling section between first and second tensioning rolls.

4. A method according to claim 1, wherein; said stretching in said stretcher levelling section is carried out at a stretching ratio of between 0.2 to 0.3 percent.

5. A method according to claim 1 wherein: said stretching and bending device comprises rolls being of a diameter smaller than the diameter of said tensioning rolls.

* * * * *